US008798274B2

(12) United States Patent
Sakai et al.

(10) Patent No.: US 8,798,274 B2
(45) Date of Patent: Aug. 5, 2014

(54) ACOUSTIC APPARATUS, ACOUSTIC ADJUSTMENT METHOD AND PROGRAM

(75) Inventors: Kazuki Sakai, Tokyo (JP); Takashi Kanai, Chiba (JP)

(73) Assignee: Sony Corporation, Tokyo (JP)

( * ) Notice: Subject to any disclaimer, the term of this patent is extended or adjusted under 35 U.S.C. 154(b) by 39 days.

(21) Appl. No.: 13/406,080

(22) Filed: Feb. 27, 2012

(65) Prior Publication Data

US 2012/0224701 A1 Sep. 6, 2012

(30) Foreign Application Priority Data

Mar. 4, 2011 (JP) ..... 2011-047370

(51) Int. Cl.
*H04R 5/00* (2006.01)

(52) U.S. Cl.
USPC ..... 381/17; 381/300; 381/303; 381/304; 381/305; 381/56; 381/58; 381/59; 381/96; 381/97; 381/98

(58) Field of Classification Search
CPC ..... H04S 1/002; H04S 5/00; H04S 7/301; H04S 3/00; H04R 5/02; H04R 29/00; H04R 29/001; H04R 3/002; H04R 1/403; H04R 3/04; H04R 1/345; H04N 11/00; G01H 3/14; H03F 1/36; H03G 5/165
USPC ..... 381/17, 303, 56, 58, 59, 96, 97, 98, 381/300, 304, 305
See application file for complete search history.

(56) References Cited

U.S. PATENT DOCUMENTS

2002/0136414 A1 * 9/2002 Jordan et al. ..... 381/58

FOREIGN PATENT DOCUMENTS

JP 7-184293 7/1995

* cited by examiner

*Primary Examiner* — Vivian Chin
*Assistant Examiner* — Paul Kim
(74) *Attorney, Agent, or Firm* — Sony Corporation

(57) ABSTRACT

An acoustic apparatus which outputs test signals from a plurality of speakers configuring a multichannel reproduction system and adjusts acoustic characteristics by picking up response signals from the speakers using a microphone, includes a test signal storage unit storing test signals output from the speakers; a response signal storage unit storing response signals from the speakers picked up by the microphone; a parameter calculation unit calculating acoustic adjustment parameters including at least a polarity reversal parameter and a phase filter parameter based on the response signals from the speakers stored in the response signal storage unit; and an acoustic adjustment parameter storage unit storing the acoustic adjustment parameters calculated by the parameter calculation unit. The parameter calculation unit calculates the polarity reversal parameter using a low-pass component of the response signals.

16 Claims, 7 Drawing Sheets

ACOUSTIC APPARATUS, ACOUSTIC ADJUSTMENT METHOD AND PROGRAM

BACKGROUND

The present disclosure relates to an acoustic apparatus, an acoustic adjustment method and a program, in particular, to an acoustic apparatus and the like adjusting acoustic characteristics of a plurality of speakers configuring a multichannel reproduction system.

In the related art, a multichannel reproduction system handling a multichannel sound signal such as a 5.1 channel signal or the like has hitherto been common. In order to accurately realize a surround effect using the multichannel sound signal, examples of the necessary conditions are that the distances to each of the front speaker, the center speaker, and the surround speakers from the listening position are all equal, that all the speakers are the same, and that the same amplitude characteristics and phase characteristics are provided.

However, in a reproduction environment in a typical home, it is often the case that the above-mentioned conditions are not satisfied due to the physical limitations of the room, the speakers, and the like. In such a case, in order to accurately realize the surround effect, it is important to appropriately adjust the acoustic characteristics of the sound signal output from each speaker.

In the related art, there has been an acoustic apparatus provided with an automatic acoustic characteristic adjustment function which is capable of automatically adjusting the acoustic characteristics of the audio signals output from each speaker. Such an apparatus outputs a test signal such as noise or an impulse signal to each speaker in advance, picks up a response signal from each speaker using a microphone placed in a listening position, and performs recording. Then, each recorded signal is analyzed, an impulse response is obtained, and the time taken to arrive at the listening position from each speaker, as well as the amplitude characteristics and phase characteristics of each speaker are calculated. Further, a delay amount and a filter coefficient for compensating for the difference in the arrival time during the response signal period from each speaker, the difference in the amplitude characteristic, and the difference in the phase characteristic are calculated.

During sound signal reproduction, the acoustic apparatus applies a delay process and a filter process to the output signal to each speaker and outputs an optimal signal to each speaker based on the above-mentioned calculated result. The number of channels to which the delay process and filter process are applied is basically 5 channels except for dedicated low-pass channels; however, the number of channels may be 7 channels, 9 channels or more.

In the acoustic apparatus of Japanese Unexamined Patent Application Publication No. 07-184293, description is given of performing compensation of the speaker output during reverse phase connection. That is, the acoustic apparatus outputs a test signal of a pulse waveform to each speaker and picks up a response signal from each speaker using a mike. Here, determination of the polarity is performed by comparing the reference signs of the values of the waveform peaks of the test signal and the response signal, and it is judged that when the reference signs are the same, the connection of the speaker is in-phase, and when the reference signs are different, the connection of the speaker is reverse phase. Here, in the case of reverse phase connection, compensation of the speaker output during reverse phase connection is performed by reversing the polarity of the signal to be supplied to the speakers.

SUMMARY

When simultaneously performing adjustment of the acoustic characteristics during multichannel sound signal reproduction, it is important to adjust the acoustic characteristics with limited resources for calculation. In particular, it is desirable to improve the efficiency of each filter process adjusting the amplitude characteristic and the phase characteristic. In a general filter process, using an IIR filter (Infinite-duration Impulse Response) employs fewer calculation resources than using an FIR (Finite Impulse Response) filter. Therefore, it is possible to use an IIR filter to adjust an amplitude characteristic. In such a case, the phase distortion caused by the IIR filter may be permitted, or the phase characteristic adjustment may be performed taking the phase distortion caused by the IIR filter into consideration.

In contrast, using the IIR filter generating phase distortion to adjust the phase characteristic is problematic. Therefore, generally, an FIR filter is used to adjust the phase characteristic. However, in the FIR filter, there are the opposite problems as below.

(1) It is important to reduce the coefficient size of the FIR filter to reduce the calculation resources.

(2) It is important to increase the coefficient size of the FIR filter to adjust the low-pass phase characteristic.

It is desirable to reduce the coefficient size of a phase adjustment filter (FIR filter) and promote cost reduction.

According to an embodiment of the present disclosure, there is provided an acoustic apparatus outputting test signals from a plurality of speakers configuring a multichannel reproduction system, and adjusting acoustic characteristics by picking up response signals from the speakers using a microphone, including: a test signal storage unit storing test signals output from the speakers; a response signal storage unit storing response signals from the speakers picked up by the microphone; a parameter calculation unit calculating acoustic adjustment parameters including at least a polarity reversal parameter and a phase filter parameter based on the response signal from the speakers stored in the response signal storage unit; and an acoustic adjustment parameter storage unit storing the acoustic adjustment parameters calculated by the parameter calculation unit, in which the parameter calculation unit calculates the polarity reversal parameter using the low-pass component of the response signal.

According to the embodiment of the present disclosure, there is also provided an acoustic apparatus outputting test signals from a plurality of speakers configuring a multichannel reproduction system, and adjusting acoustic characteristics by picking up response signals from the speakers using a microphone. In such a case, test signals from the test signal storage unit are read out and supplied to the speakers. Further, the response signals from the speakers picked up by the microphone are stored in the response signal storage unit.

Then, based on the response signal from the speakers stored in the response signal storage unit, acoustic adjustment parameters including at least a polarity reversal parameter and a phase filter parameter are calculated. In such a case, the polarity reversal parameter is calculated using the low-pass component of the response component. Here, the acoustic adjustment parameters calculated in such a manner are stored in the acoustic adjustment parameter storage unit.

For example, the parameter calculation unit is set to determine the polarity based on the area ratio of the area of the positive reference sign side and the area of the negative reference sign side in the waveform of the low-pass component of the response signal, and calculate the polarity reversal parameter. Here, for example, the response signal picked up by the microphone is an impulse response signal. The parameter calculation unit is set to apply a low frequency pass filter to the step response signal obtained by convoluting a step signal in the impulse response signal, and to obtain a low-pass component of the response signal. In this manner, by determining the polarity based on the area ratio of the area of the positive reference sign side and the area of the negative reference sign side in the waveform of the low-pass component of the response signal, it is possible to determine the polarity of the low-pass component of the response signal with high precision.

In this manner, according to the embodiment of the present disclosure, the acoustic adjustment parameters include at least the polarity reversal parameter and the phase filter parameter, and the polarity reversal parameter is calculated using the low-pass component of the response signal from the speakers picked up using the microphone. Therefore, when adjusting the acoustic characteristics during reproduction of the multichannel sound signal, by performing a polarity reversal process of the sound signal based on the above-mentioned polarity reversal parameter, it is possible to greatly reduce the low-pass phase adjustment amount in the phase adjustment process. Therefore, even in a case of using, for example, an FIR filter as a phase adjustment filter, it is possible to greatly reduce the coefficient size and promote cost reduction.

Here, according to the embodiment of the present disclosure, for example, the parameter calculation unit is set to calculate a polarity reversal parameter so that the polarity of the low-pass component of the response signal matches the desired polarity. In such a case, for example, in a case where a predetermined speaker selected from a plurality of speakers, for instance, a plurality of speakers configuring the multichannel reproduction system, includes a front speaker, the desired polarity is set as the polarity of the low-pass component of the response signal from the front speaker. Thus, by setting the desired polarity as the polarity of the low-pass component of the response signal from the predetermined speakers selected from the plurality of speakers, the configuration of the acoustic adjustment unit during reproduction of the multichannel sound signal is simplified. That is, in the acoustic adjustment unit, a polarity reversal circuit and a phase adjustment filter may be not provided in the sound signal channel of the predetermined speaker.

Further, according to another embodiment of the present disclosure, there is provided an acoustic apparatus outputting a sound signal to a plurality of speakers configuring a multichannel reproduction system, including: an acoustic adjustment unit adjusting acoustic characteristics of the sound signal to be output to the plurality of speakers; an acoustic adjustment parameter storage unit storing acoustic adjustment parameters set by the acoustic adjustment unit, in which the acoustic adjustment unit includes at least a polarity reversal circuit and a phase adjustment filter, and a polarity reversal parameter calculated using a low-pass component of response signals from the speakers is set as the acoustic adjustment parameter in the polarity reversal circuit.

According to the embodiment of the present disclosure, there is provided an acoustic apparatus outputting a sound signal to a plurality of speakers configuring a multichannel reproduction system. According to the embodiment, the acoustic characteristics of the sound signal output to the plurality of speakers are adjusted by the acoustic adjustment unit. The acoustic adjustment unit includes at least a polarity reversal circuit and a phase adjustment filter.

Here, the acoustic adjustment parameters set by the acoustic adjustment unit are stored in the acoustic adjustment parameter storage unit. The acoustic adjustment parameters are calculated based on the response signal from the speakers, while the polarity reversal parameters set by the polarity reversal circuit and included in the acoustic adjustment parameters are calculated using the low-pass component of the response signal.

In this manner, according to the embodiment of the present disclosure, when adjusting the acoustic characteristics during reproduction of the multichannel sound signal, a polarity reversal process of the sound signal is performed in the polarity reversal circuit of the sound adjustment unit based on the above-mentioned polarity reversal parameter. Therefore, the low-pass phase adjustment amount is greatly reduced in the phase adjustment filter of the sound adjustment unit. Accordingly, even in a case of using, for example, an FIR filter as a phase adjustment filter, it is possible to greatly reduce the coefficient size and promote cost reduction.

According to the embodiment of the present disclosure, for example, it is set such that the polarity reversal parameters are calculated so that the polarity of the low-pass component of the response signal matches the polarity of the low-pass component of the response signal from the predetermined speaker selected from the plurality of speakers, and the acoustic adjustment unit has a polarity reversal circuit and a phase adjustment filter in a sound signal channel corresponding to speakers other than the predetermined speaker from the plurality of speakers. For example, the plurality of speakers configuring the multichannel reproduction system includes a front speaker and the predetermined speaker is set as the front speaker. In such a case, in the acoustic adjustment unit, a polarity reversal circuit and a phase adjustment filter may be not provided in the sound signal channel of the predetermined speaker, whereby the configuration is simplified.

According to the embodiments of the present disclosure, the coefficient size of the phase adjustment filter (FIR filter) in the tone adjustment unit adjusting the acoustic characteristics during reproduction of the multichannel sound signal is reduced and it is possible to promote cost reduction.

DETAILED DESCRIPTION OF EMBODIMENTS

Below, forms for realizing the present disclosure (hereafter, "embodiments") will be described. In addition, description will be given in the following order.

1. Embodiments
2. Modifications

1. Embodiments

[Configuration Example of Multichannel Reproduction System]

Figure 1:
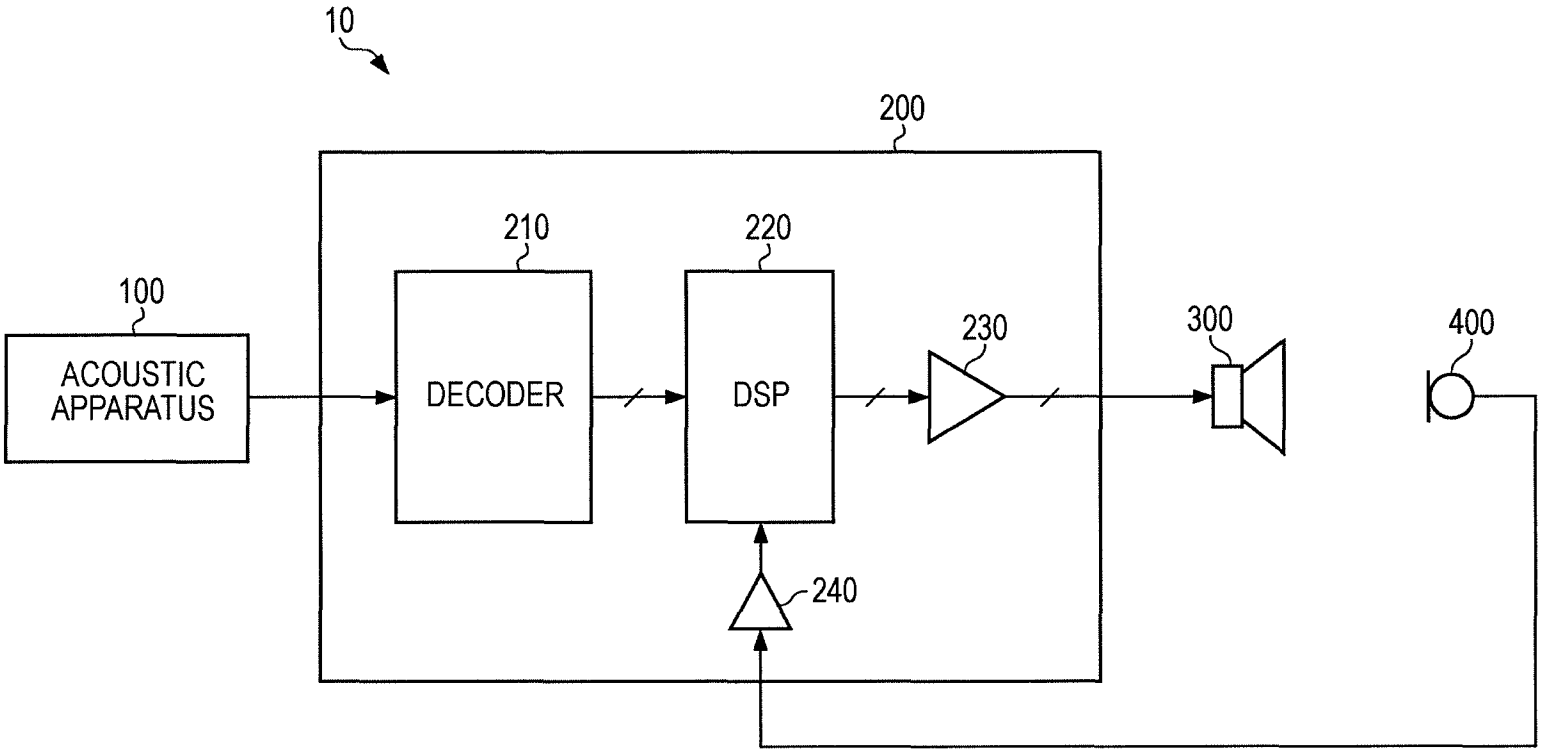
FIG. 1 is a block diagram showing a configuration example of a multichannel reproduction system as an embodiment of the present disclosure.

FIG. 1 shows a configuration example of a multichannel reproduction system 10 as an embodiment of the present disclosure. The multichannel reproduction system 10 has a sound signal output apparatus 100, an acoustic apparatus 200, speakers 300, and a microphone 400. The sound signal output apparatus 100 is a DVD reproduction apparatus or the like, and outputs a 5.1 channel compressed sound signal in AC3 (Audio Code number 3) format, for example.

The acoustic apparatus 200 has a decoder 210, a DSP (Digital Signal Processor) 220, an amplifier 230, and an amplifier 240. The decoder 210 performs a decoding process with respect to the AC3 format compressed sound signal output from the sound signal output apparatus 100 and outputs the sound signal for each channel of 5.1 channel audio. Here, the sound signal of each channel is a front left signal, a front right signal, a center signal, a surround left (rear left) signal, a surround right (rear right) signal and a subwoofer signal.

The DSP 220 configures an acoustic analysis block when the acoustic apparatus 200 is in an analysis phase. The acoustic analysis block calculates acoustic adjustment parameters for performing acoustic adjustment such as phase adjustment and amplitude adjustment with respect to the sound signals output to the speakers 300. The detailed configuration of the acoustic analysis block will be described later.

In addition, the DSP 220 configures an acoustic adjustment block when the acoustic apparatus 200 is in a reproduction phase. The acoustic adjustment block performs acoustic adjustment with respect to the sound signals output to the speakers 300 using the acoustic adjustment parameters calculated in the acoustic analysis block described above. The detailed configuration of the acoustic adjustment block will be described below.

The amplifier 230 amplifies the signals to be output to the speakers 300 from the DSP 220. That is, when the acoustic apparatus 200 is in the analysis phase, the test signals to be output from the DSP 220 as the acoustic analysis block are amplified and supplied to the speakers 300. Further, when the acoustic apparatus 200 is in the reproduction phase, the sound signals to be output from the DSP 220 as the acoustic analysis block are amplified and supplied to the speakers 300. Further, as described later, the amplifier 240 amplifies the response signals from the speakers 300 picked up by the microphone 400 and supplies the signals to the DSP 220.

The speakers 300 are 5.1 channel speakers. The speakers 300 are configured of a front left speaker, a front right speaker, a center speaker, surround left (rear left) speaker, a surround right (rear right) speaker and a subwoofer. The above mentioned DSP 220 calculates acoustic adjustment parameters respectively corresponding to each speaker when configured as the acoustic analysis block. Further, the above-mentioned DSP 220 performs acoustic adjustment using the acoustic adjustment parameters with respect to the sound signals respectively output to each speaker when configured as the acoustic adjustment block.

The microphone 400 is arranged and used in a listening position when the acoustic apparatus 200 is in the analysis phase. The microphone 400 picks up the response signals from the speakers 300 and supplies the signals to the DSP 220 as the acoustic analysis block.

The multichannel reproduction system 10 shown in FIG. 1 performs the following operation when the acoustic apparatus 200 is in the analysis phase and the DSP 220 configures the acoustic analysis block. In such a case, test signals are output from the DSP 220. The test signals are output from the speakers 300 after being amplified in the amplifier 230. Further, the response signals from the speakers 300 are picked up using the microphone 400 arranged at the listening position and supplied to the DSP 220. In the DSP 220, the acoustic adjustment parameters for performing acoustic adjustment with respect to the sound signals output to the speakers 300 are calculated based on the response signals.

In addition, the multichannel reproduction system 10 shown in FIG. 1 performs the following operation when the acoustic apparatus 200 is in the reproduction phase and the DSP 220 configures the acoustic adjustment block. In such a case, an AC3 format compressed sound signal of reproduction content from the sound signal output apparatus 100 is output and the compressed sound signal is input to the decoder 210 of the acoustic apparatus 200. In the decoder 210, a decoding process is carried out with respect to the AC3 format compressed sound signal and a sound signal for each channel of 5.1 channel audio is obtained. These sound signals are supplied to the DSP 220. Using the acoustic adjustment parameters calculated in the acoustic analysis block, acoustic adjustment is performed with respect to the sound signals in the DSP 220. Here, the acoustically adjusted sound signals are output from the speakers 300 after being amplified in the amplifier 230.

[Description of DSP=Acoustic Analysis Block]

Figure 2:
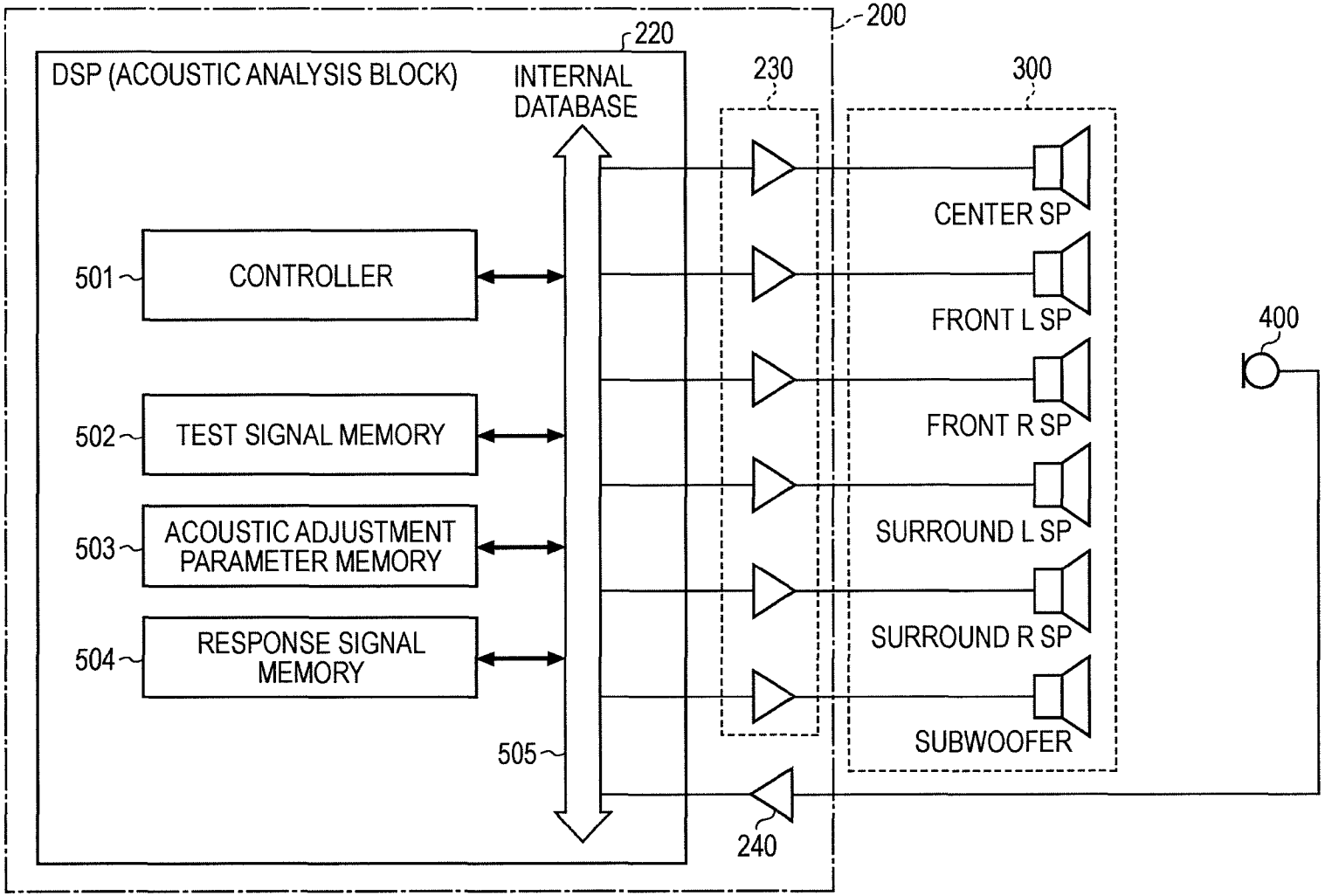
FIG. 2 is a diagram showing a configuration example of an acoustic analysis block configured by a DSP when the acoustic apparatus is in an analysis phase.

When the acoustic apparatus 200 is in an analysis phase, as mentioned above, the DSP 220 configures an acoustic analysis block. FIG. 2 shows a configuration example of the DSP 220 in such a case. In FIG. 2, portions corresponding to FIG. 1 are shown with the same reference signs attached. In such a case, the DSP 220 is provided with a controller 501, a test signal memory 502, an acoustic adjustment parameter memory 503, a response signal memory 504 and an internal data bus 505. The controller 501, the test signal memory 502, the acoustic adjustment parameter memory 503 and the response signal memory 504 are connected to the internal data bus 505.

The controller 501 controls the operation of each part of the DSP 220 as the acoustic analysis block. The test signal memory 502 stores the test signals (impulse signal) output from the speakers 300. The acoustic adjustment parameter memory 503 stores the acoustic adjustment parameters calculated in the analysis phase. The acoustic adjustment parameters include, as described later, a polarity reversal parameter, a phase filter parameter, an amplitude filter parameter, a delay parameter, and the like. The response signal memory 504 stores response signals from the speakers 300 picked up by the microphone 400.

The controller 501 in the acoustic analysis block sequentially reads out test signals from the test signal memory 502 and outputs the signals from the target speaker. At the same time, the response signals from the speakers picked up using the microphone 400 installed at the listening position are stored in the response signal memory 504. Thereafter, the test signals are output from all the speakers and the response signals thereof are sequentially stored in the response signal memory 504. Subsequently, the controller 501 sequentially calculates each acoustic adjustment parameter relating to the polarity reversal process, the phase filter process, the amplitude filter process, and the delay process, based on each response signal stored in the response signal memory 504, and stores the result in the acoustic adjustment parameter memory 503.

Figure 3:
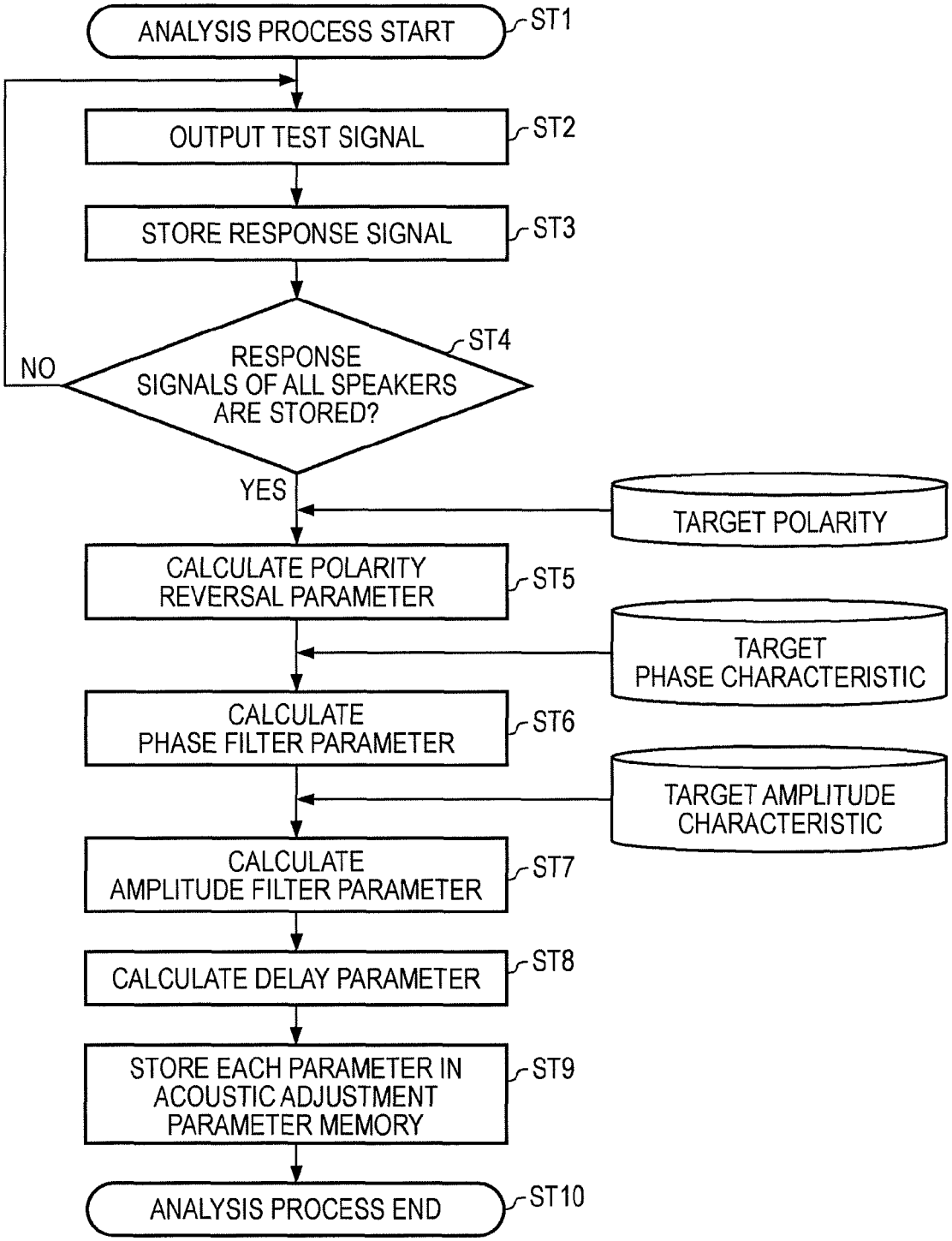
FIG. 3 is a flowchart for describing the sequence of acoustic analysis processes in the controller configuring the acoustic analysis block.

The flowchart of FIG. 3 shows a sequence of acoustic analysis processes in the controller 501. The controller 501 starts the analysis process in step ST1 and thereafter proceeds to the process of step ST2. In step ST2, the controller 501 reads out the test signal from the test signal memory 502 and outputs the test signal to the target speaker through the amplifier 230 from the internal data bus 505. Here, in step ST3, the controller 501 receives the response signal through the internal data bus 505 from the target speaker picked up at the microphone 400, and stores the signal in the response signal memory 504.

Next, in step ST4, the controller 501 determines whether or not response signals of all the speakers are stored. When it is determined that response signals of all the speakers are not stored, the controller 501 returns to step ST2, sets the next speaker as the target speaker, and repeats the same processes as mentioned above. Here, "all the speakers" refers to the center speaker, the front left speaker, the front right speaker, the surround left speaker, the surround right speaker and the subwoofer included in the speakers 300.

When it is determined in step ST4 that the response signals of all the speakers are stored, in step ST5, the controller 501 sequentially sets each speaker as the target speaker and calculates the polarity reversal parameters of the target speakers. In such a case, the polarity reversal parameter is calculated so that the polarity of the low-pass component of the response signal matches the desired polarity. The polarity reversal parameter reduces the adjustment amount of the low-pass phase characteristic using the phase adjustment filter (FIR filter) and is a multiplier coefficient of the polarity reversal circuit set to have the aim of reducing the size of the coefficient.

Figure 4:
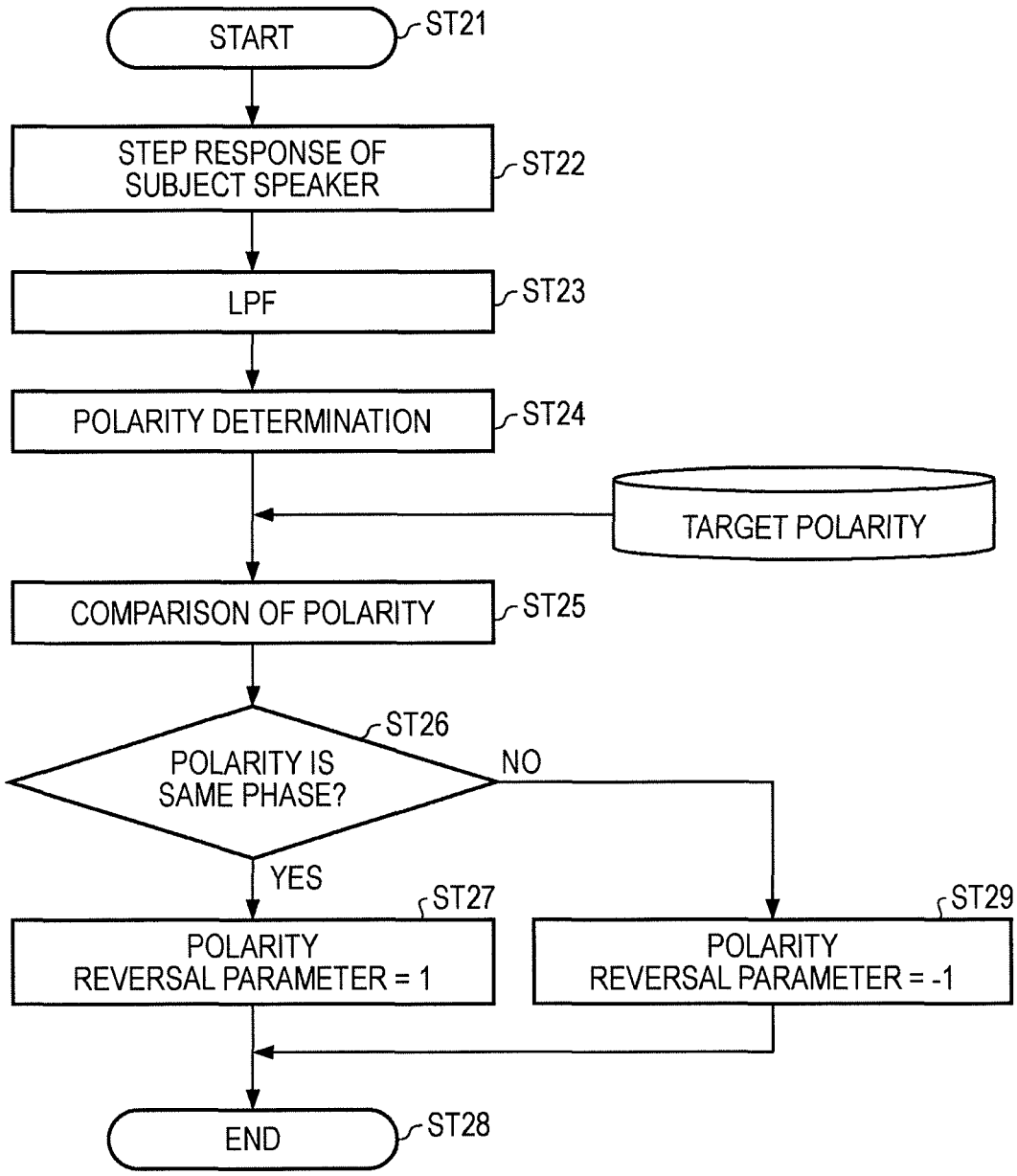
FIG. 4 is a flowchart for describing the sequence of calculation processes of the polarity reversal parameter of the target speaker in the controller configuring the acoustic analysis block.
Figure 5A:
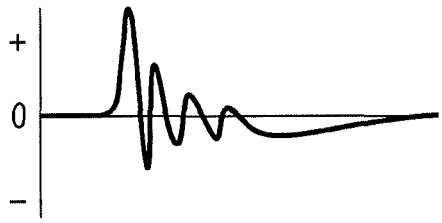
FIGS. 5A, 5B, 5C, and 5D are waveform diagrams for describing the sequence of calculation processes of the polarity reversal parameter of the target speaker.
Figure 5B:
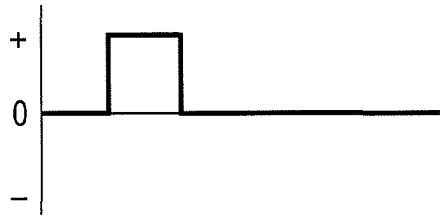
Figure 5C:
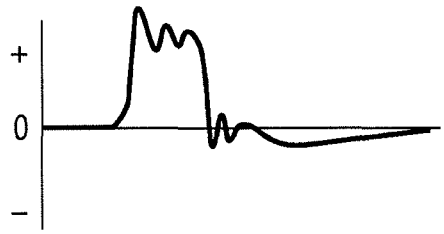

The flowchart of FIG. 4 shows the sequence of calculation processes of the polarity reversal parameter of the target speaker in the controller 501. The controller 501 starts the calculation process in step ST21 and thereafter proceeds to the process of step ST22. In the step ST22, a step response of the target speaker is obtained. In such a case, for example, the controller 501 convolutes a signal as shown in FIG. 5B in a pulse response signal from a target speaker as shown in FIG. 5A, and obtains a step response signal as shown in FIG. 5C.

Figure 5D:
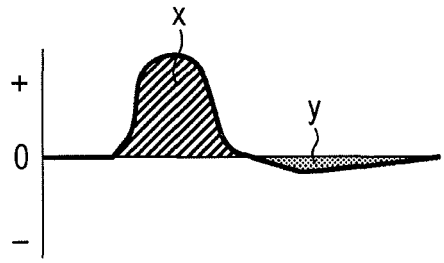

Next, in step ST23, the controller 501 applies a low-pass filter (LPF) with respect to the step response signal obtained in step ST22 and extracts a low-pass component of the step response signal as shown in FIG. 5D. In this case, the low-pass filter, for example, is set to have a cut-off frequency of 200 Hz to 500 Hz.

Next, in step ST24, the controller 501 determines the polarity of the low-pass component extracted in step ST23. In such a case, the controller 501 calculates the area of the positive reference sign side (the x portion in FIG. 5D) and the area of the negative reference sign side (the y portion in FIG. 5D) of the waveform formed of the low-pass component of the step response signal, and the reference sign of which the area is largest is determined as the polarity of the low-pass component of the step response signal of the target speaker.

Next, in step ST25, the controller 501 compares the polarity of the low-pass component of the step response signal of the target speaker and the desired polarity. Here, in step ST26, the controller 501 determines whether or not the polarity is the same phase. When the polarity is the same phase, in step ST27, the controller 501 sets the polarity reversal parameter to "1", and thereafter, in step ST28, the process is terminated. Meanwhile, when the polarity is not the same phase, that is, when it is a different phase, the controller 501 sets the polarity reversal parameter to "−1" in step ST29 and thereafter terminates the process in step ST28.

In this embodiment, the desired polarity is set as the polarity of the low-pass component of the step response signal of the front speaker. In such a case, a speaker with the same characteristics as the front left speaker and the front right speaker is used, and the speaker connection is also performed in the same manner. Here, the polarity of the low-pass component of the step response signal of either of the front left speaker or the front right speaker is set as the desired polarity. By using the polarity of the low-pass component of the step response signal of the front speaker as the desired polarity, the front speaker is no longer one for which the polarity reversal parameter is to be calculated in step ST5.

In addition, according to the embodiment, the phase characteristic and amplitude characteristic of the front speaker are similarly used also in relation to the desired phase characteristic and desired amplitude characteristic to be described later. Accordingly, according to the embodiment, initially, based on the response signal from the front speaker, the polarity, phase characteristic, and amplitude characteristic thereof are calculated. Here, as described later, the front speaker is no longer one for which the phase filter parameter and the amplitude filter parameter to be described below are to be calculated as well as not being one for which the polarity reversal parameter is to be calculated.

Returning to FIG. 3, the controller 501 calculates the phase filter parameter in step ST6 after calculating the polarity reversal parameter in step ST5. In such a case, the controller 501 sequentially sets each speaker (excluding the front speakers and subwoofer) as the target speaker and calculates the phase filter parameters thereof.

To obtain an accurate surround effect, it is preferable that the phase characteristics of each speaker all be equal. In a case where different types of speakers are mixed or a case where sounds reflected from walls or the like have a great influence on the reproduction environment, the phase characteristics of each speaker become different. In such a case, it is important that the appropriate filter be applied and that the phase characteristics of all the speakers be equalized.

In step ST6, the controller 501 calculates the difference between the desired phase characteristic and the phase characteristic according to FFT (Fast Fourier Transform) analysis of the response signal from the target speaker. Here, the coefficient value of the phase adjustment filter having the characteristic of compensating for the difference is calculated as the phase filter parameter. In such a case, with respect to the target speaker for which the polarity reversal parameter is set to "−1", the controller 501 calculates the difference with respect to the desired phase characteristic after the phase characteristic of the target speaker is reversed.

As the desired phase characteristic, a linear phase characteristic, a phase characteristic of a specific speaker, or the like may be set; however, as described above, according to the embodiment, the phase characteristic of the front speaker is used as the desired phase characteristic. The phase characteristic according to FFT analysis of one of the response signals from the response signals from the two front speakers of the front left speaker and the front right speaker, or of a response signal averaged from both is set as the desired phase characteristic.

Next, in step ST7, the controller 501 calculates the amplitude filter parameter. In such a case, the controller 501 sequentially sets each speaker (excluding the front speakers and subwoofer) as the target speaker and calculates the amplitude filter parameters of the target speakers.

To obtain an accurate surround effect, it is preferable that the amplitude characteristics of each speaker all be equal. In a case where different types of speakers are mixed or a case where sounds reflected from walls or the like have a great influence on the reproduction environment, the amplitude characteristics of each speaker become different. In such a case, it is important that the appropriate filter be applied and that the amplitude characteristics of all the speakers be equalized.

In step ST7, the controller 501 calculates the difference between the desired amplitude characteristic and the amplitude characteristic according to FFT (Fast Fourier Transform) analysis of the response signal from the target speaker. Here, the coefficient value of the amplitude compensation filter having the characteristic of compensating for the difference is calculated.

As the desired amplitude characteristic, a flat phase characteristic, an amplitude characteristic of a specific speaker, or the like may be set; however, as described above, according to the embodiment, the amplitude characteristic of the front speaker is used as the desired amplitude characteristic. The amplitude characteristic according to FFT analysis of one of the response signals from the response signals from the two front speakers of the front left speaker and the front right speaker, or of a response signal averaged from both is set as the desired amplitude characteristic.

Next, in step ST8, the controller 501 calculates the delay filter parameter. In such a case, the controller 501 sequentially sets each speaker as the target speaker and calculates the delay parameter thereof.

To obtain an accurate surround effect, it is preferable that the distances between each speaker and the listening position all be equal. However, installing all the speakers at equal distances may often be difficult in a typical home. In such a case, by providing the appropriate delays with respect to the signals supplied to the speakers near the listening position, time alignment of each channel reproduction signal is performed at the listening position and as a result it is possible to equalize all the speaker distances. The distance of each speaker from the listening position may be calculated by multiplying the time taken for the test signal to reach the microphone 400 by the speed of sound.

As described above, by setting the front speaker as the desired speaker, the controller 501 makes the phase characteristic and amplitude characteristic of the center speaker and the surround speakers match the phase characteristic and amplitude characteristic of the front speaker. Accordingly, in the acoustic adjustment block, with respect to the output signal to the front speaker, the phase filter process and the amplitude filter process are not performed. Here, in step ST8, the controller 501 calculates the delay parameter of each speaker, taking into consideration the delay time taken by the filter processes with respect to the output signal to the center speaker and the surround speaker.

Next, in step ST9, the controller 501 stores the acoustic adjustment parameters of each speaker calculated respectively in step ST5 to step ST8 in the acoustic adjustment parameter memory 503. The acoustic adjustment parameters include, as described above, a polarity reversal parameter, a phase filter parameter, an amplitude filter parameter and a delay parameter. Here, in step ST10, the controller 501 terminates the analysis process.

[Description of DSP=Acoustic Adjustment Block]

Figure 6:
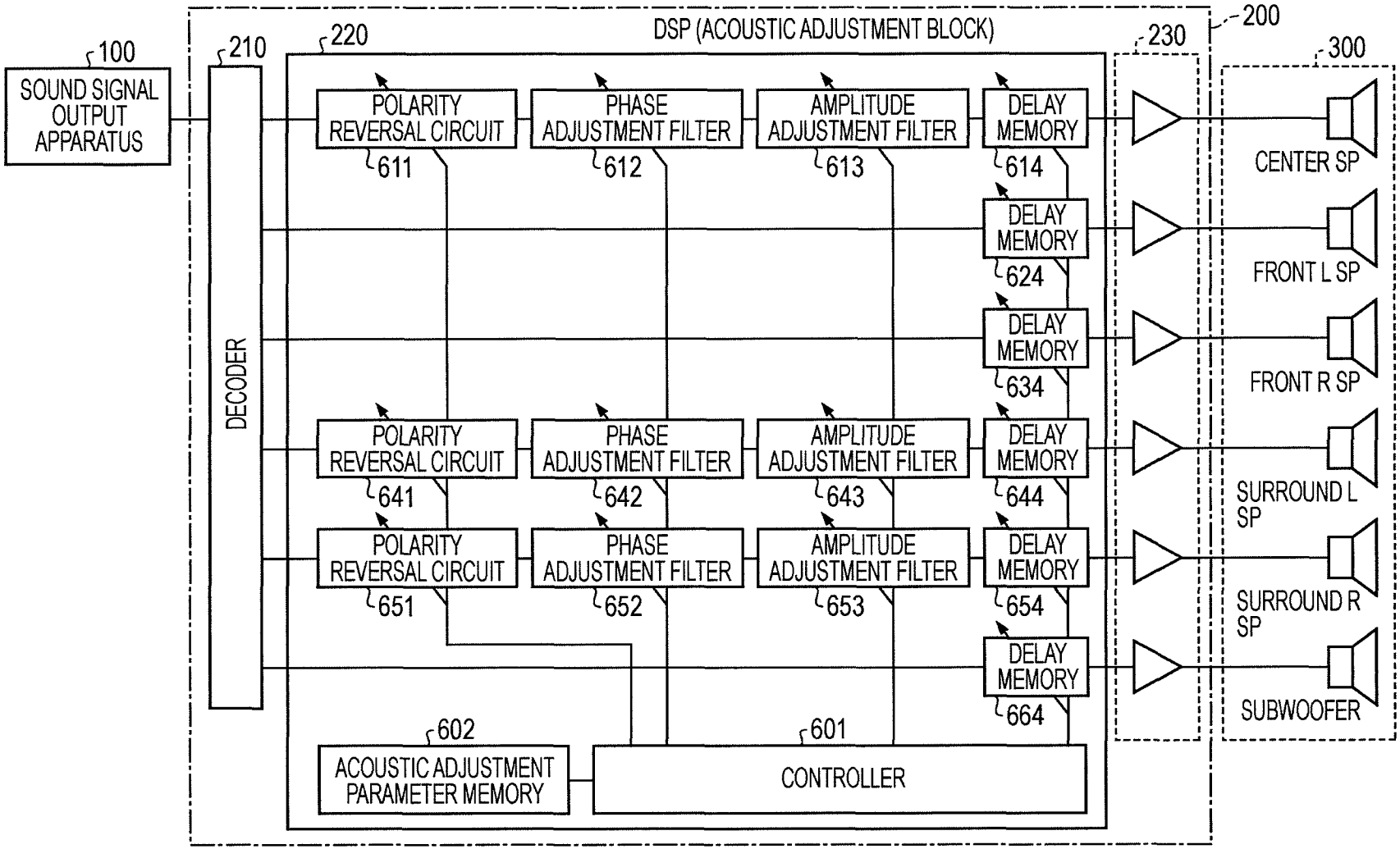
FIG. 6 is a diagram showing a configuration example of an acoustic adjustment block configured by the DSP when the acoustic apparatus is in a reproduction phase.

When the acoustic apparatus 200 is in a reproduction phase, as mentioned above, the DSP 220 configures an acoustic adjustment block. FIG. 6 shows a configuration example of the DSP in such a case. In FIG. 6, portions corresponding to FIG. 1 are shown with the same reference signs attached. In such a case, the DSP 220 is provided with a controller 601, and an acoustic adjustment parameter memory 602. The acoustic adjustment parameter memory 602 is the same as the acoustic adjustment parameter memory 503 (refer to FIG. 2) in the above-mentioned acoustic adjustment block. The acoustic adjustment parameters of each speaker calculated in the above-mentioned acoustic analysis block are stored in the acoustic adjustment parameter memory 602.

In addition, in the sound signal channel of the center speaker (center SP), the DSP 220 has a polarity reversal circuit 611, a phase adjustment filter 612, an amplitude adjustment filter 613 and a delay memory 614. Further, in the sound signal channel of the front left speaker (front LSP), the DSP 220 has a delay memory 624. Moreover, in the sound signal channel of the front right speaker (front RSP), the DSP 220 has a delay memory 634.

Furthermore, in the sound signal channel of the surround left speaker (surround LSP), the DSP 220 has a polarity reversal circuit 641, a phase adjustment filter 642, an amplitude adjustment filter 643, and a delay memory 644. Additionally, in the sound signal channel of the surround right speaker (surround RSP), the DSP 220 has a polarity reversal circuit 651, a phase adjustment filter 652, an amplitude adjustment filter 653, and a delay memory 654. In addition, in the sound signal channel of the subwoofer, the DSP 220 has a delay memory 664.

Here, for example, the phase adjustment filters 612, 642, and 652 are configured by FIR filters so as not to generate phase distortion. In contrast, the amplitude adjustment filters 613, 643, and 653 are configured by FIR filters or IIR filters.

The controller 601 controls the operation of each part of the DSP 220 as an acoustic adjustment block. The controller 601 reads out the acoustic adjustment parameters of each speaker stored in the acoustic adjustment parameter memory 602 and sets the polarity reversal circuit, phase adjustment filter, amplitude adjustment filter, and delay memory in the sound signal channel of each speaker.

The polarity reversal circuits 611, 641, and 651 multiply the input sound signal by the multiplication coefficient "1" or "−1" as the set polarity reversal parameter, and, as appropriate, perform polarity reversal of the input sound signal. The phase adjustment filters 612, 642, and 652 adjust the phase characteristics of the center speaker, the surround left speaker, and the surround right speaker to match the phase characteristic of the front speaker. The amplitude adjustment filters 613, 643, and 653 adjust the amplitude characteristics of the center speaker, the surround left speaker, and the surround right speaker to match the amplitude characteristic of the front speaker. The delay memories 614 to 664 adjust the delay time of each sound signal so that the output signal from each speaker reaches the listening position at the same time.

As the acoustic adjustment block shown in FIG. 6, the DSP 220 performs acoustic adjustment with respect to the sound signals of each speaker. That is, the sound signal of the center speaker output from the decoder 210 is acoustically adjusted by the polarity reversal circuit 611, the phase adjustment filter 612, the amplitude adjustment filter 613 and the delay memory 614, at which point the adjusted sound signal is supplied to the center speaker through the amplifier 230.

Further, the sound signal of the front left speaker output from the decoder 210 is acoustically adjusted by the delay memory 624, at which point the acoustically adjusted sound signal is supplied to the front left speaker through the amplifier 230. Furthermore, the sound signal of the front right speaker output from the decoder 210 is acoustically adjusted by the delay memory 634, at which point the acoustically adjusted sound signal is supplied to the front right speaker through the amplifier 230.

In addition, the sound signal of the surround left speaker output from the decoder 210 is acoustically adjusted by the polarity reversal circuit 641, the phase adjustment filter 642, the amplitude adjustment filter 643 and the delay memory 644, at which point the adjusted sound signal is supplied to the surround left speaker through the amplifier 230. In addition, the sound signal of the surround right speaker output from the decoder 210 is acoustically adjusted by the polarity reversal circuit 651, the phase adjustment filter 652, the amplitude adjustment filter 653 and the delay memory 654, at which point the adjusted sound signal is supplied to the surround right speaker through the amplifier 230.

In addition, the sound signal of the subwoofer output from the decoder 210 is acoustically adjusted by the delay memory 664, at which point the acoustically adjusted sound signal is supplied to the subwoofer through the amplifier 230.

As described above, in the multichannel reproduction system 10 shown in FIG. 1, when the acoustic apparatus 200 is in an analysis phase, the DSP 220 configures an acoustic analysis block. Thus, in the acoustic analysis block, acoustic adjustment parameters for performing acoustic adjustment such as phase adjustment and amplitude adjustment with respect to the sound signals output to the speakers 300 are calculated. In such a case, the acoustic adjustment parameters include a polarity reversal parameter. The polarity reversal parameter is calculated using the low-pass component of response signals from the speakers 300 picked up using the microphone 400.

Therefore, when adjusting the acoustic characteristics during reproduction, by performing a polarity reversal process of the sound signal based on the above-mentioned polarity reversal parameter, it is possible to greatly reduce the low-pass phase adjustment amount in the phase adjustment process. Accordingly, as the phase adjustment filter for example, even in a case of using an FIR filter, it is possible to greatly reduce the coefficient size thereof and to promote cost reduction.

Furthermore, in the multichannel reproduction system 10 shown in FIG. 1, in the acoustic analysis block configured by the DSP 220, the polarity reversal parameter is calculated using the low-pass component of the response signals from the speakers 300 picked up using the microphone 400. In such a case, by determining the polarity based on the area ratio of the area of the positive reference sign side and the area of the negative reference sign side in the waveform of the low-pass component of the response signal, it is possible to determine the polarity of the low-pass component of the response signal with high precision.

For example, as the speakers, a plurality of units, for instance, high-pass speaker units and low-pass speaker units may be configured. In such a case, when the phase polarity is determined when the peak point of the response signal is on the positive reference sign side or on the negative reference sign side, the determination result may not represent the polarity of the low-pass component.

Figure 7A:
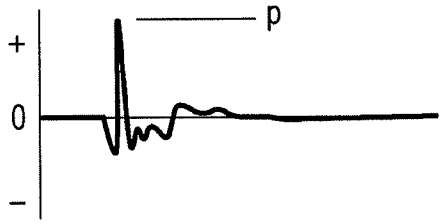
FIGS. 7A, 7B, 7C, and 7D are diagrams for describing that it is possible to determine the polarity of the low-pass component of the response signal with high precision by determining the polarity based on the area ratio of the area of the positive reference sign side and the area of the negative reference sign side in the waveform of the low-pass component of the response signal.

For example, FIG. 7A shows an example of an impulse response signal from a speaker where the high-pass phase polarity is in-phase and the low-pass phase polarity is reverse phase. In such a case, when the phase polarity is determined at the peak point (p), it is determined to be in-phase.

Figure 7B:
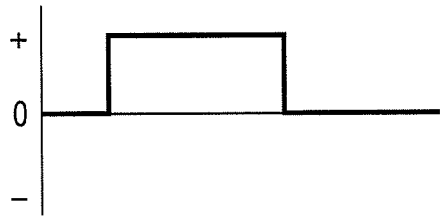
Figure 7C:
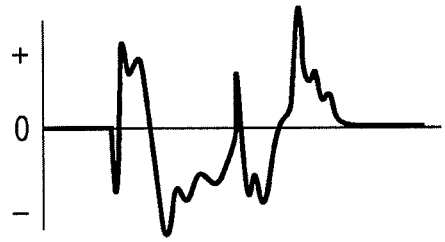

However, when the step signal as shown in FIG. 7B is convolved in the impulse response signal from the speaker as shown in FIG. 7A, the step response signal as shown in FIG. 7C is obtained. Here, when the low-pass filter (LPF) is applied with respect to the step response signal, the low-pass component of the step response signal is extracted, as shown in FIG. 7D.

Figure 7D:
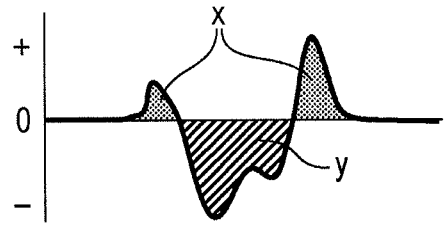

The area of the negative reference sign side of the waveform formed of the low-pass component of the step response signal (the y portion in FIG. 7D) becomes larger than the area of the positive reference sign side (the x portion in FIG. 7D). Therefore, the polarity of the low-pass component of the response signal from the speaker is correctly determined as reverse phase.

Further, in the multichannel reproduction system 10 shown in FIG. 1, in the acoustic analysis block configured by the DSP 220, the acoustic adjustment parameters (polarity reversal parameter, phase filter parameter, amplitude filter parameter, and delay parameter) of each speaker are calculated. In such a case, the polarity, the phase characteristic and amplitude characteristic of the low-pass component of the response signal from the front speaker are set as desired, and the acoustic adjustment parameters of the other speakers are calculated. Therefore, when the acoustic apparatus 200 is in the reproduction phase, in the acoustic adjustment block configured by the DSP 220, the polarity reversal circuit, the phase adjustment filter, and the amplitude adjustment filter may not be provided in the sound signal channel of the front speaker, whereby the configuration is simplified.

2. Modification

Here, in the above-described embodiment, in the acoustic analysis block configured by the DSP 220 when the acoustic apparatus 200 is in an analysis phase, it has been described that the polarity, the phase characteristic, and the amplitude characteristic of the front speaker are set as desired and used. However, it may be considered that, in the respective 5.1 channel speakers configuring the speakers 300, the polarities, the phase characteristics, and the amplitude characteristics of other speakers than the front speaker may be set as desired and used.

In addition, it may be considered that the polarities, the phase characteristics, and the amplitude characteristics of other speakers separate from the respective 5.1 channel speakers configuring the speakers 300, or the polarities, the phase characteristics, and the amplitude characteristics of virtual speakers may be set as desired and used. In such a case, when the acoustic apparatus 200 is in the reproduction phase, in the acoustic adjustment block configured by the DSP 220, the polarity reversal circuit, the phase adjustment filter, and the amplitude adjustment filter should be provided in the sound signal channel of the front speaker.

Moreover, according to the embodiment described above, an example of a multichannel reproduction system 10 handling a 5.1 channel sound signal is given. Naturally, the present disclosure may also be applied in a similar manner to a multichannel reproduction system handling other multichannel sound signals such as 7.1 channel audio.

The present disclosure contains subject matter related to that disclosed in Japanese Priority Patent Application JP 2011-047370 filed in the Japan Patent Office on Mar. 4, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An acoustic apparatus, comprising:

a test signal storage unit configured to store test signals output from a plurality of speakers;

a response signal storage unit configured to store response signals from the plurality of speakers picked up by a microphone;

a control unit configured to calculate acoustic adjustment parameters including at least a polarity reversal parameter and a phase filter parameter based on the stored response signals; and an acoustic adjustment parameter storage unit configured to store the calculated acoustic adjustment parameters, wherein the polarity reversal parameter is calculated using a low-pass component of the response signals.

2. The acoustic apparatus according to claim 1, wherein the control unit is confiqured to determine polarity based on an area ratio of an area of a positive reference sign side and an area of a negative reference sign side in a waveform of the low-pass component of the response signals, and calculate the polarity reversal parameter.

3. The acoustic apparatus according to claim 2, wherein the response signals picked up by the microphone are impulse response signals, and wherein the control unit is configured to apply a low frequency pass filter to a step response signal obtained by convoluting a step signal in the impulse response signals, and to obtain the low-pass component of the response signals.

4. The acoustic apparatus according to claim 1, wherein the control unit is configured to calculate the polarity reversal parameter so that a polarity of the low-pass component of the response signals matches a desired polarity.

5. The acoustic apparatus according to claim 4, wherein the desired polarity is a polarity of the low-pass component of a response signal from a predetermined speaker selected from the plurality of speakers.

6. The acoustic apparatus according to claim 5, wherein the plurality of speakers configuring a multichannel reproduction system comprises a front speaker, which is the predetermined speaker.

7. An acoustic adjustment method outputting test signals from a plurality of speakers configuring a multichannel reproduction system, and adjusting acoustic characteristics by picking up response signals from the speakers using a microphone, comprising:

outputting test signals from the plurality of speakers;

picking up response signals from the plurality of speakers using the microphone;

calculating acoustic adjustment parameters including at least a polarity reversal parameter and a phase filter parameter based on the response signals picked up from the plurality of speakers; and storing the calculated acoustic adjustment parameters, wherein the polarity reversal parameter is calculated using a low-pass component of the response signals.

8. The method according to claim 7, further comprising determining polarity based on an area ratio of an area of a positive reference sign side and an area of a negative reference sign side in a waveform of the low-pass component of the response signals, and calculating the polarity reversal parameter.

9. The method according to claim 7, wherein the response signals picked up by the microphone are impulse response signals.

10. The method according to claim 9, further comprising applying a low frequency pass filter to a step response signal obtained by convoluting a step signal in the impulse response signals, and obtaining the low-pass component of the response signals.

11. The method according to claim 7, further comprising calculating the polarity reversal parameter so that a polarity of the low-pass component of the response signals matches a desired polarity.

12. The method according to claim 11, wherein the desired polarity is a polarity of the low-pass component of a response signal from a predetermined speaker selected from the plurality of speakers.

13. A non-transitory computer-readable storage medium having stored thereon, a computer program having at least one code section for processing, the at least one code section being executable by a computer for causing the computer to perform steps comprising:

outputting test signals from a plurality of speakers configuring a multichannel reproduction system;

storing response signals from the plurality of speakers picked up by a microphone;

calculating acoustic adjustment parameters including at least a polarity reversal parameter and a phase filter parameter based on the stored response signals; and storing the calculated acoustic adjustment parameters, wherein the polarity reversal parameter is calculated using a low-pass component of the response signals.

14. An acoustic apparatus outputting a sound signal to a plurality of speakers configuring a multichannel reproduction system, comprising:

an acoustic adjustment unit configured to adjust acoustic characteristics of the sound signal to be output to the plurality of speakers;

an acoustic adjustment parameter storage unit configured to store acoustic adjustment parameters set based on response signals from the plurality of speakers, wherein the acoustic adjustment unit comprises at least a polarity reversal circuit and a phase adjustment filter, wherein the stored acoustic adjustment parameters are calculated based on the response signals from the plurality of speakers, and a polarity reversal parameter included in the acoustic adjustment parameters is calculated using a low-pass component of the response signals from the plurality of speakers.

15. The acoustic apparatus according to claim 14, wherein the polarity reversal parameter is calculated so that a polarity of the low-pass component of the response signals matches a polarity of a low-pass component of a response signal from a predetermined speaker selected from the plurality of speakers, and wherein the polarity reversal circuit and the phase adjustment filter are included in a sound signal channel corresponding to a speaker other than the predetermined speaker from the plurality of speakers.

16. The acoustic apparatus according to claim 15, wherein the plurality of speakers configuring the multichannel reproduction system comprises a front speaker, which is the predetermined speaker.

* * * * *